United States Patent [19]

Arichi et al.

[11] 4,440,503

[45] Apr. 3, 1984

[54] ELECTRONIC TIMER

[75] Inventors: Isao Arichi, Kurahsiki; Tetuya Waniisi; Takuji Koh, both of Okayama, all of Japan

[73] Assignee: Omron Tateisi Electronics Co., Kyoto, Japan

[21] Appl. No.: 299,582

[22] Filed: Sep. 4, 1981

[30] Foreign Application Priority Data

Sep. 8, 1980 [JP] Japan ..... 55-128312[U]

[51] Int. Cl.[3] ..... G04F 10/02

[52] U.S. Cl. ..... 368/107; 368/155; 368/201

[58] Field of Search ..... 368/107, 108, 110, 113, 368/155, 201; 84/DIG. 18, 454; 364/703

[56] References Cited

U.S. PATENT DOCUMENTS

| | | | |
|---|---|---|---|
| 3,789,600 | 2/1974 | Champon | 368/110 |
| 3,877,216 | 4/1975 | Mounce et al. | 368/108 |
| 4,005,571 | 2/1977 | Wolff | 368/108 |
| 4,027,470 | 6/1977 | Friedman | 368/110 |
| 4,222,226 | 9/1980 | Miyatake et al. | 368/113 |
| 4,255,805 | 3/1981 | Jaunin | 368/108 |
| 4,256,008 | 3/1981 | Ryon | 84/DIG. 18 |

*Primary Examiner*—F. W. Isen

*Attorney, Agent, or Firm*—Cushman, Darby & Cushman

[57] ABSTRACT

An electronic timer with a case having two windows and a manually adjustable control on the exterior. The output of an oscillator within the case is applied to a first frequency divider dividing the frequency by a factor manually selected by a switch indicating the factor in one window. The output of the first divider is applied to a second divider dividing by a factor selected manually by a second switch viewable through the other window and indicating timing in seconds, minutes, hours or days.

3 Claims, 7 Drawing Figures

ELECTRONIC TIMER

BRIEF SUMMARY OF THE INVENTION

This invention relates to an electronic timer, and more particularly to an oscillation counting timer which is used in a sequence circuit device or the like.

There is well known an oscillation counting timer with a multiple time range which includes a pulse generator or oscillator, a frequency divider for receiving a pulse train generated from the pulse generator, and a counter for counting outputs from the frequency divider, dividing factors of the frequency divider being selected for a plurality of time ranges. Such a conventional timer has an operation panel marked with a plurality of time scales in accordance with the respective dividing factors, but has the disadvantages that if a great number of time ranges are designated to be performed, the design of the operation panel is complicated with many different time scale and not practical in use.

It is, therefore, a primary object of this invention to provide an electronic timer with a multiple time range in which a time scale on an operation panel is used in common for a plurality of time scales.

It is a further object of this invention to provide an electronic timer having a plurality of time ranges which can be externally selected with ease.

Other objects and advantages of this invention will be apparent upon reference to the following description in conjunction with the accompanying drawings, in which:

DETAILED DESCRIPTION

Figure 1:
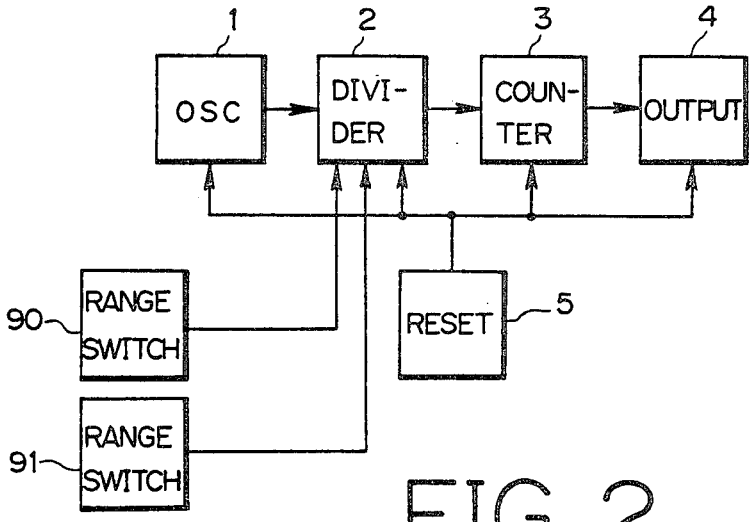
FIG. 1 is a schematic block diagram of an electronic timer as a preferred embodiment of this invention.
Figure 2:
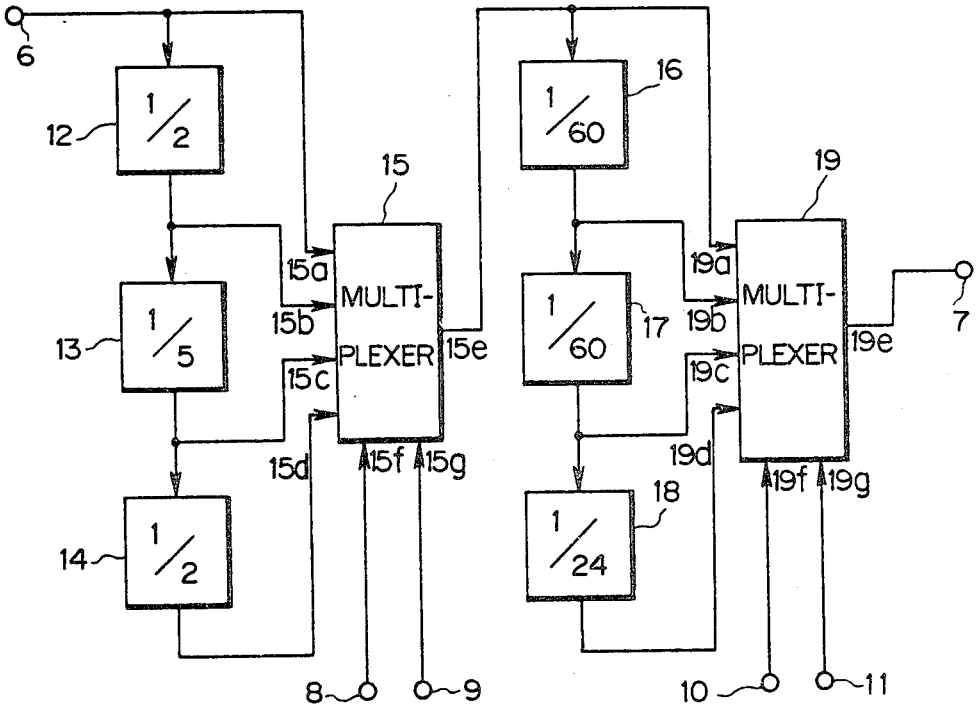
FIG. 2 is a block diagram of a frequency divider employed in the timer of FIG. 1.
Figure 7:
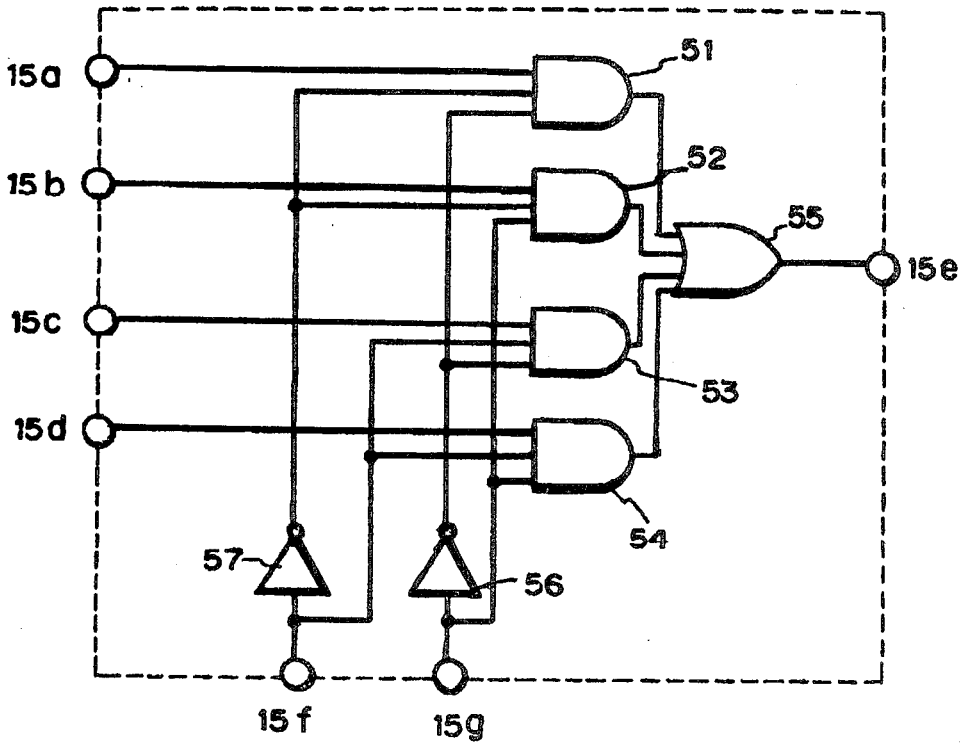
FIG. 7 is a detailed block diagram showing a multiplexer which is employed in the frequency divider of FIG. 2.

Referring, now, to FIG. 1, there is shown an oscillation counting timer as a preferred embodiment of this invention, which includes an oscillator 1 for developing outputs or a pulse train, a frequency divider 2 for dividing the frequency of the pulse train, a counter 3 which on counting a predetermined number of outputs of the divider 2 generates an output, an output circuit 4 which in response to the output from the counter 3 switches a load (not shown) connected thereto, a reset circuit 5, and a pair of time range setting switches 90 and 91 for selecting a couple of dividing factors of the divider 2. In FIG. 2 there is illustrated in detail the frequency divider 2 having an input terminal 6 connected to the oscillator 1 and an output terminal 7 connected to the counter 3. The frequency divider 2 consists of dividing circuits 12, 13 and 14 with the respective dividing factors 1/2, 1/5 and 1/2, a multiplexer 15 for selecting one of signals divided by the factors 1/1, 1/2, 1/10 and 1/20 in accordance with a logic input applied to input terminals 8 and 9, dividing circuits 16, 17 and 18 with the respective dividing factors 1/60, 1/60 and 1/24, and a multiplexer 19 for selecting one of signals divided by the factors 1/1, 1/60, 1/(60×60) and 1/(60×60×24) in accordance with a logic input applied to input terminals 10 and 11. In FIG. 7 the multiplexer 15 is exemplarily illustrated in detail, which includes AND-gates 51 to 54, an OR-gates 55, and inverters 56 and 57. If both input terminals **15*f* and 15*g* are at low levels, a signal at terminal 15*a* appears at output terminal 15*e*. If the terminals 15*f* and 15*g* are at low and high levels, respectively, a signal at terminal 15*b* appears at the terminal 15*e*. Thus, by applying a high or low signal to the input terminals 15*f* and 15*g*, one of input signals at the terminals 15*a* to 15*d* is selected to appear at the terminal 15*e*. The multiplexer 19 employs the same circuit as that of FIG. 7, and by applying a high or low signal to input terminals 10 and 11, one of signals at terminals 19*a* to 19*d* is selected to appear at terminal 7. The outputs from the oscillator 1 are applied to the respective terminals 15*a*, 15*b*, 15*c* and 15*d* at the dividing factors of 1/1, 1/2, 1/(2×5) and 1/(2×5×2), so that in accordance with the logic signals at the terminals 8 and 9, the multiplexer 15 selects a multiplying factor of a time range of the timer. The outputs from the multiplexer 15 are applied to the respective terminals 19*a*, 19*b*, 19*c* and 19*d* at the dividing factors of 1/1, 1/60, 1/(60×60) and 1/(60×60×24), so that in accordance with the logic signals at the terminals 10 and 11, the multiplexer 19 selects a time unit of a time range of the timer. The time range setting switch 90 is coupled to the terminals 8 and 9 to select a multiplying factor, and the switch 91 is coupled to the terminals 10 and 11** to select a time unit.

Thus, the timer of FIG. 1 performs the sixteen time ranges as shown in the following table:

TABLE I

| | X | | | |
|---|---|---|---|---|
| Y | 0.5 (8 = L 9 = L) | 1 (8 = L 9 = H) | 5 (8 = H 9 = L) | 10 (8 = H 9 = H) |
| SEC (10 = L 11 = L) | 0.5 sec | 1 sec | 5 sec | 10 sec |
| MIN (10 = L 11 = H) | 0.5 min (30 sec) | 1 min | 5 min | 10 min |
| HOUR (10 = H 11 = L) | 0.5 hour (30 min) | 1 hour | 5 hour | 10 hour |
| DAY (10 = H 11 = H) | 0.5 day (12 hour) | 1 day | 5 day | 10 day |

X: Multiple Factor
Y: Time Unit

In Table 1, the numerals "8" and "9" in the first row and the numerals "10" and "11" in the first column represent terminals 8 and 9 and terminals 10 and 11 of FIG. 2, and "L" and "H" represent a low level signal and a high level signal applied to the respective terminals 8 to 11. For instance, if the terminals 8 and 10 are supplied with a low level signal and the terminals 9 and 11 are supplied with a high level signal, the timer of FIG. 1 is set into the time range of 1 minute.

Figure 3:
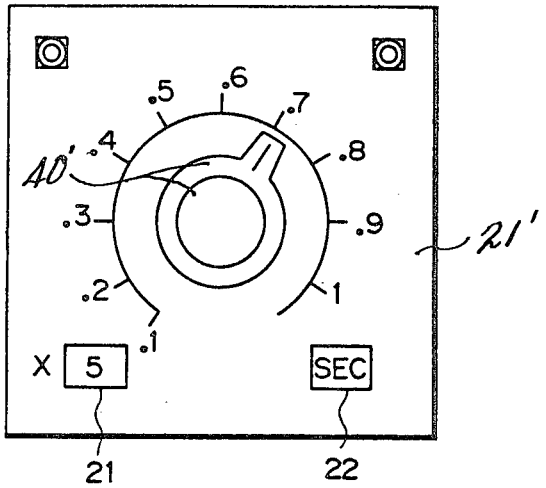
FIG. 3 is a first elevation assembled view of the timer of FIG. 1.
Figure 4:
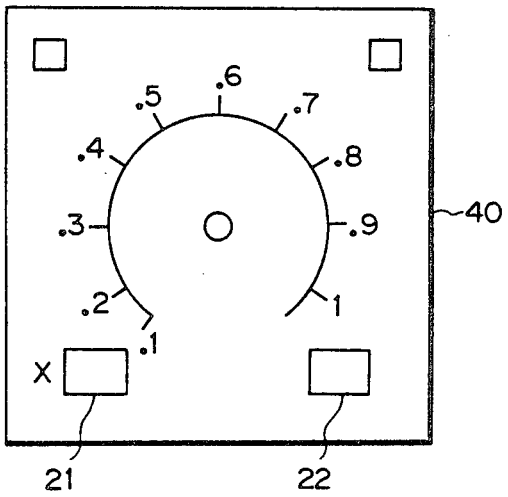
FIG. 4 is a plan view showing a time scale plate mounted on the timer of FIG. 3.

FIG. 3 is a front view of an operation panel of the timer, which includes a window 21 in case 21' for displaying a time multiplying factor ("5" in FIG. 3) and a window 22 for displaying a time unit ("sec" in FIG. 3). Thus, simply by changing the time multiplying factor and time unit in the windows 21 and 22, the time scale on the operation panel can be used in common for the sixteen time ranges in Table 1. In FIG. 4 there is shown a time scale plate 40 mounted on the panel in FIG. 3 which is used in common for the sixteen time ranges. Manually adjustable control 40' is used for setting the desired time.

Figure 5:
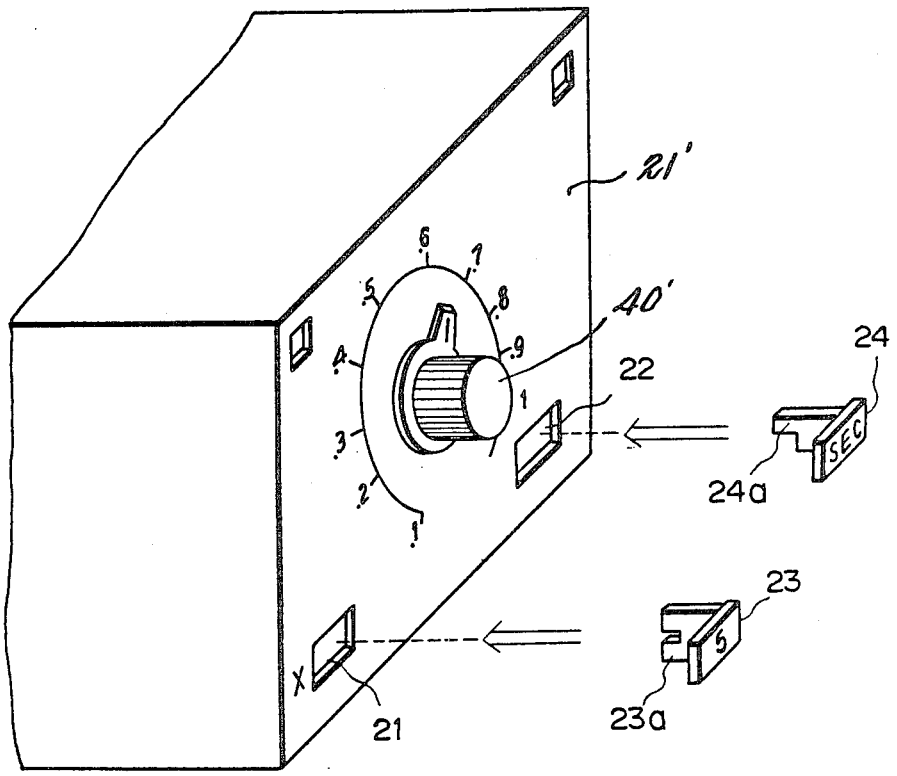
FIGS. 5 and 6 are perspective partial views showing the timers of FIG. 1, time ranges of which are preset by a pair of key switches and a pair of rotary switches.

In FIG. 5 there are shown the time range setting switches 90 and 91 which employ set keys 23 and 24. The set keys 23 and 24 are prepared for each multiplying factor and for each time unit listed in Table 1, and marked in the designations of the respective multiplying factors and time units. Moreover, they have distinct configurations of inserting portions (23*a*, 24*a*) to specify their multiplying factors or time units. If the set keys 23 and 24 are inserted into the windows 21 and 22, their inserting portions 23*a* and 24*a* actuate the respective switches 90 and 91 which are installed inside the windows 21 and 22 so that predetermined logic signals corresponding to the respective set keys 23 and 24 may be applied to the terminals 8 to 11.

Figure 6:
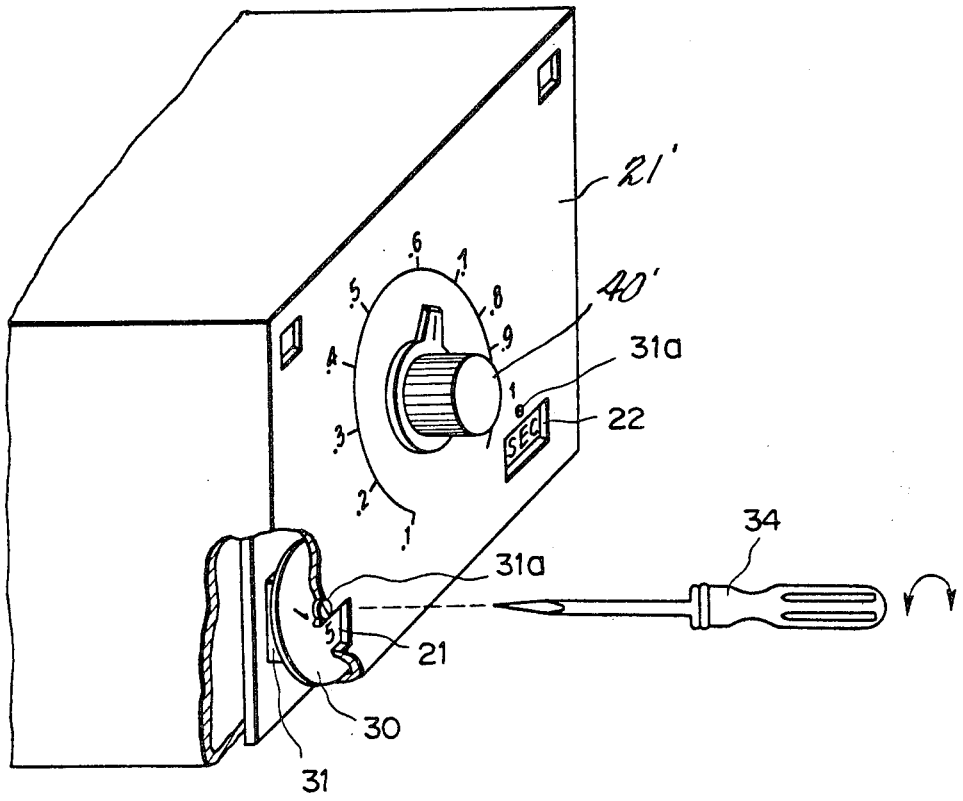

Alternatively, the time range setting switches 90 and 91 may employ a pair of rotary switches (31) and rotary indication disks (30) fixed to rotary shafts (31*a*) of the rotary switches (31) as shown in FIG. 6. The rotary switches (31) are installed inside the windows 21 and 22. The rotary shafts (31*a*) of the switches are adapted to be rotated by an external driver 34 so as to select a multiplying factor and a time unit for indication in the windows 21 and 22 and for application of predetermined logic signals to the terminals 8 to 11.

Thus, the electronic timer according to this invention includes a pair of selecting circuits for selecting a time multiplying factor and a time unit, and a pair of switches upon changing an indication in a display window for changing a logic signal as a selecting signal applied to the selecting circuits, so that a single time scale plate on an operation panel of the timer can be used for a great number of time ranges in common.

It should be understood that the above description is merely illustrative of this invention and that many changes and modifications may be made by those skilled in the art without departing from the scope of the appended claims.

What is claimed is:

1. An electronic timer comprising:

a case having first and second windows and a manually adjustable control therein for setting a desired time;

an oscillator within said case;

a first frequency divider within said case for dividing the output of said oscillator at one of a plurality of first dividing factors;

first selecting means within said case for manually selecting one of said first factors including switch means having a display viewable through said first window and indicating a multiplication factor for the set time;

a second frequency divider within said case for dividing the output of said first selecting means by one of a plurality of second dividing factors; and second selecting means within said case for manually selecting one of said second factors including switch means having a display viewable through said second window and indicating timing in seconds, minutes, hours, or days.

2. A timer as in claim 1 wherein said switch means each include rotary switches.

3. A timer as in claim 1 wherein said switch means each include insertable set keys having distinct configurations to specify the factors.

* * * * *

UNITED STATES PATENT AND TRADEMARK OFFICE

CERTIFICATE OF CORRECTION

PATENT NO. : 4,440,503

DATED : April 2, 1982

INVENTOR(S) : Arichi, Isao; Wahiisi,Tetuya; Koh, Takuji

It is certified that error appears in the above-identified patent and that said Letters Patent is hereby corrected as shown below:

Column 2, Table I should be deleted to appear as shown below.

Table 1

| Y \ X | 0.5 (8=L 9=L) | 1 (8=L 9=H) | 5 (8=H 9=L) | 10 (8=H 9=H) |
|---|---|---|---|---|
| SEC (10=L 11=L) | 0.5 sec | 1 sec | 5 sec | 10 sec |
| MIN (10=L 11=H) | 0.5 min (30 sec) | 1 min | 5 min | 10 min |
| HOUR (10=H 11=L) | 0.5 hour (30 min) | 1 hour | 5 hour | 10 hour |
| DAY (10=H 11=H) | 0.5 day (12 hour) | 1 day | 5 day | 10 day |

Signed and Sealed this

*Twenty-second* Day of *January 1985*

[SEAL]

*Attest:*

DONALD J. QUIGG

*Attesting Officer*

*Acting Commissioner of Patents and Trademarks*